US006095856A

United States Patent [19]

Horan et al.

[11] Patent Number: 6,095,856

[45] Date of Patent: Aug. 1, 2000

[54] HOLDER CONNECTOR APPARATUS AND METHODS

[75] Inventors: Patrick J. Horan, Dover, N.H.; Mark R. Arsenault, Sanford, Me.; Wayne T. Sortwell, Goffstown, N.H.

[73] Assignee: General Electric Company, Schenectady, N.Y.

[21] Appl. No.: 09/183,888

[22] Filed: Oct. 30, 1998

[51] Int. Cl.[7] ..... H01R 13/62; H01R 13/60

[52] U.S. Cl. ..... 439/567; 439/329

[58] Field of Search ..... 439/329, 567, 439/78, 571, 572

[56] References Cited

U.S. PATENT DOCUMENTS 3,864,007 2/1975 Plyler et al. ..... 339/17 LC
4,998,887 3/1991 Kaufman et al. ..... 439/78
5,419,721 5/1995 Lignelet ..... 439/701
5,613,877 3/1997 Patel et al. ..... 439/567
5,797,767 8/1998 Schell ..... 439/490

*Primary Examiner*—Lincoln Donovan
*Assistant Examiner*—Chandrika Prasad
*Attorney, Agent, or Firm*—Carl Horton, Esq.; Armstrong Teasdale LLP

[57] ABSTRACT

A connector holder assembly includes a printed circuit board and a support having a plurality of header openings, plug openings, and snaps. The openings are in communication with a plurality of cavities and a plurality of ribs extend into the cavities. A plurality of plug connectors are configured to be inserted into the cavities through the plug openings. The support and plug connectors are configured to be positioned on the printed circuit board. The snaps engage a plurality of snap openings on the printed circuit board and include a slot that allows flexure of the snaps during insertion into the snap openings.

26 Claims, 4 Drawing Sheets

HOLDER CONNECTOR APPARATUS AND METHODS

BACKGROUND OF THE INVENTION

This invention relates generally to connectors and, more particularly, to a multi-contact, multi-connector apparatus for a utility meter.

Utility meters are used to determine the amount of a utility, such as electricity, gas, or water, consumed at a given site. In particular, conventional residential electricity meters are watt-hour meters which measure total energy consumed at the site and indicate the usage in standard kilowatt hours. Modern residential electric meters typically include solid-state electronics for monitoring, storing, and displaying utility usage data over time.

Generally, options can be installed in electronic meters after the meter has entered service. These options can include a telephone modem and RS232 serial communication capability. For a serial communication option, a printed circuit board snaps into a bezel of the meter and makes an electrical connection with a main board of the meter. An input/output cable plugs into an input/output connector including a plurality of pins located on the printed circuit board. The cable is then passed through an opening of fixed size in the bottom of the meter. A problem arises when the connector is too large to pass through the opening in the bottom of the meter, e.g., due to a large number of connecting pins.

Accordingly, it would be desirable to provide a connector that could be passed through the opening in the bottom of the meter, regardless of the number of pins required to be on the connector.

BRIEF SUMMARY OF THE INVENTION

These and other objects may be attained by a connector holder assembly that includes a connector support having a first and a second header opening, a first and a second plug opening, and at least one snap. A first plug connector is configured to be inserted through the first plug opening and into the connector support, and a second plug connector is configured to be positioned through the second plug opening and into the connector support. The connector holder assembly further includes a printed circuit board (PCB) including at least one snap opening. The snap can be positioned within the snap opening and is configured to engage the snap opening and maintain the connector support in contact with the PCB. The PCB further includes two header assemblies having a plurality of pins. The first header assembly fits within the first header opening, and the second header assembly fits within the second header opening.

The connector support further includes an intermediate wall, a first cavity, and a second cavity. The first plug connector is inserted through the first plug opening and into the first cavity and the second plug connector is inserted through the second plug opening and into the second cavity.

The intermediate wall and the side walls of the connector support include a plurality of ribs that extend into the cavities. The ribs contact the plug connectors and retain the plug connectors within the cavities. The plug connectors include a plurality of wires extending from a top of the connectors. The top of the connector support includes a first opening and a second opening through which the wires extend when the plug connectors are inserted into the cavities.

The header openings extend through the bottom of the connector support and the plug connectors include a bottom having a plurality of pin openings. The pin openings are configured to accept the pins of the header assemblies when the plug connectors are inserted into the cavities and the connector support is positioned on the PCB.

The snaps include a top portion, a bottom portion, and a slot. The top portion is tapered and retains the snap within the snap opening by restricting withdrawal of the snap from the snap opening. The slot extends the length of the snap and provides for flexure of the snap during engagement with the snap opening.

DETAILED DESCRIPTION OF THE INVENTION

Figure 1:
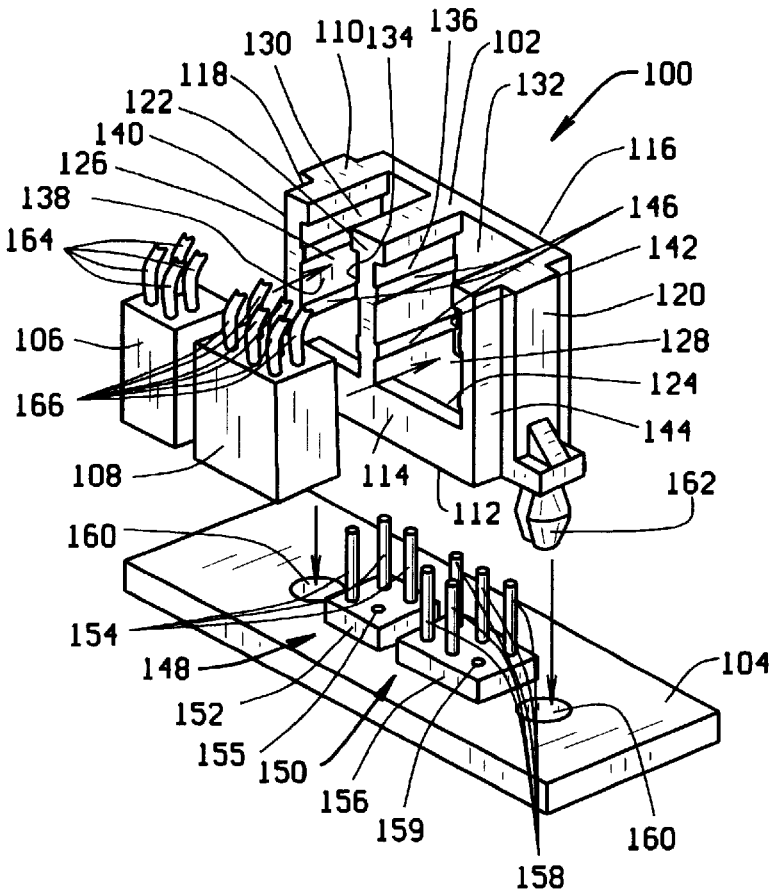
FIG. 1 is an exploded perspective view of a connector holder assembly including a connector support, a printed circuit board, and two plug connectors.

FIG. 1 is an exploded perspective view of a connector holder assembly 100 including a connector support 102, a printed circuit board (PCB) 104, a first plug connector 106, and a second plug connector 108. Connector support 102 includes a top 110, a bottom 112, a front 114, a back 116, a first end 118, a second end 120, and an intermediate wall 122. Bottom 112 includes a first bottom opening (not shown in FIG. 1) and a second bottom opening 124 extending therethrough. Front 114 includes a first plug opening 126 and a second plug opening 128 extending through front 114. A first cavity 130 is formed adjacent first end 118 and is in communication with the first bottom opening and with first plug opening 126. A second cavity 132 is formed adjacent second end 120 and is in communication with second bottom opening 124 and second plug opening 128. Intermediate wall 122 separates first cavity 130 from second cavity 132 and includes a first side 134 and a second side 136. First cavity 130 is bordered by back 116, first end 118, bottom 112, top 110, and front 114, and is formed therebetween. Second cavity 132 is bordered by back 116, second end 120, bottom 112, top 110, and front 114, and is formed therebetween.

First end 118 includes an inner side 138 and an outer side 140 and second end 120 includes an inner side 142 and an outer side 144. Inner side 138 of first end 118, inner side 142 of said second end 120, first side 134 of intermediate portion 122, and second side 136 of intermediate portion 122 include at least one rib 146 extending into cavities 130 and 132. In one embodiment, ribs 146 are tapered from front 114 to back 116. The tapering of ribs 146 permit easier initial insertion of plug connectors 106 and 108 into cavities 130 and 132 respectively. In addition, ribs 146 apply sufficient pressure to plug connectors 106 and 108 to retain connectors 106 and 108 in cavities 130 and 132, respectively, when connectors 106 and 108 are fully inserted.

PCB 104 includes a first header assembly 148 and a second header assembly 150. First header assembly 148 includes a platform 152, a plurality of pins 154 extending from platform 152, and a peg opening 155. Second header assembly 150 includes a platform 156, a plurality of pins 158 extending from platform 156, and a peg opening 159. In one embodiment, first header assembly 148 includes three pins and second header assembly 150 includes five pins. Opening 155 is configured to accept a first polarization peg (not shown) positioned on a bottom (not shown) of plug connector 106. The first polarization peg and peg opening 155 require plug connector 106 to be inserted into connector support 102 in a preselected orientation. Otherwise, the first polarization peg will not line up with peg opening 155 and plug connector 106 will not properly fit onto header assembly 148. Similarly, opening 159 is configured to accept a second polarization peg (not shown) positioned on a bottom (not shown) of plug connector 108. The second polarization peg and peg opening 159 require plug connector 108 to be inserted into connector support 102 in a preselected orientation. Otherwise, the second polarization peg will not line up with peg opening 159 and plug connector 108 will not properly fit onto header assembly 150.

PCB 104 further includes at least one snap opening 160 and support 102 further includes at least one snap 162 for insertion into opening 160. Snap 162 is configured to fit within opening 160 and to be maintained within opening 160 as described below in greater detail.

Plug connector 106 includes a first plurality of wires 164 that form at least a portion of a first cable (not shown). Similarly, plug connector 108 includes a second plurality of wires 166 that form at least a portion of a second cable (not shown). In one embodiment, the first and second cables form a single cable. Alternatively, the first cable and the second cable can remain separated from each other. When plug connectors 106 and 108 are inserted into support 102 and support 102 is then positioned on PCB 104, wires 164 and 166 are in electrical contact with pins 154 and 158, respectively.

Figure 2:
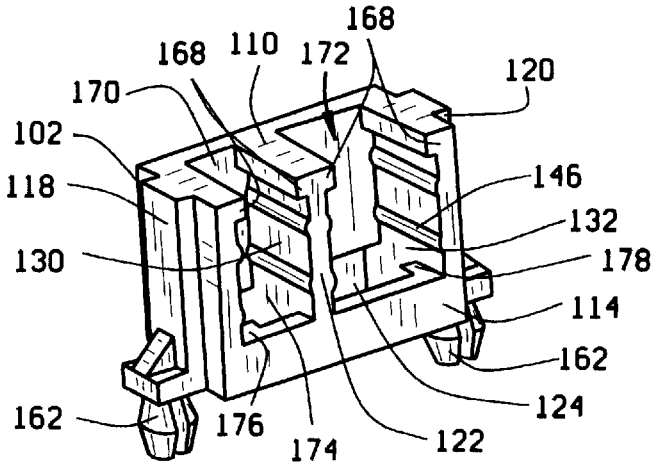
FIG. 2 is a perspective view of the connector support shown in FIG. 1.

FIG. 2 is a perspective view of connector support 102 illustrating cavities 130 and 132. Sides 118 and 120 and intermediate wall 122 include tabs 168 that extend across at least a portion of cavities 130 and 132. Top 110 includes a first top opening 170 and a second top opening 172. Top openings 170 and 172 extend between tabs 168. Tabs 168 prevent connectors 106 and 108 from exiting cavities 130 and 132 through openings 170 and 172 after connectors 106 and 108 have been inserted into cavities 130 and 132, respectively.

FIG. 2 further illustrates a first bottom opening 174 and second bottom opening 124 in connector support 102. Bottom 112 includes a first tab 176 and a second tab 178. First tab 176 and second tab 178 extend into openings 174 and 124, respectively. Tab 176 prevents the first plug connector (not shown in FIG. 2) from exiting cavity 130 through bottom opening 174. Similarly, tab 178 prevents the second plug connector (not shown in FIG. 2) from exiting cavity 132 through bottom opening 124. Tabs 176 and 178 also maintain the first and second connectors, respectively, a predetermined distance from the header platforms (not shown in FIG. 2) when connector support 102 and the first and second plug connectors are positioned on the PCB (not shown in FIG. 2).

Figure 3:
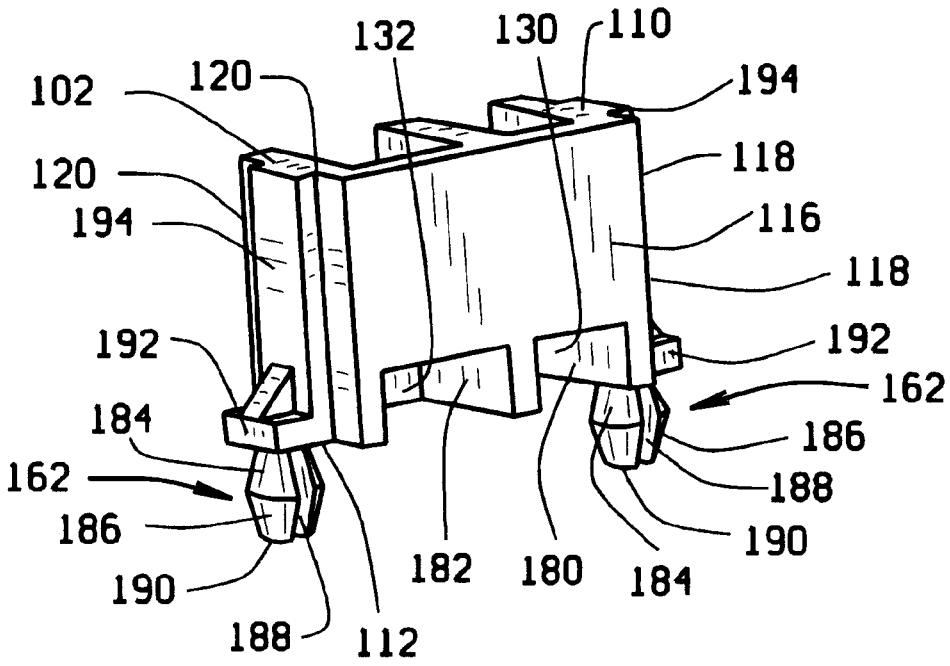
FIG. 3 is another perspective view of the connector support shown in FIG. 1.

FIG. 3 is a further perspective view of connector support 102 illustrating back 116. Connector support 102 includes a first back opening, e.g., a cutout, 180 and a second back opening, e.g., a cutout, 182. First back opening 180 is in communication with first cavity 130, and second back opening 182 is in communication with second cavity 132. In one embodiment support connector 102 is molded from a flexible thermoplastic material such as a nylon or a polyester. Back openings 180 and 182 facilitate molding the bottom tabs (not shown in FIG. 3) without requiring mold mechanisms such as side action.

FIG. 3 also illustrates snaps 162 including a top portion 184, a bottom portion 186, and a slot 188 extending through top portion 184 and bottom portion 186. In one embodiment, slots 188 extend substantially parallel to sides 118 and 120. The parallel orientation of slots 188 reduces side actions of slots 188 during the molding process. Slot 188 allows for flexure of snap 162 during engagement with the snap opening (not shown in FIG. 3) in order to permit easier insertion of snap 162 into the snap opening. Top portion 184 is tapered from bottom portion 186 to support bottom 112. In addition, bottom portion 186 is tapered from top portion 184 to an end 190 of snap 162. Bottom portion 186 is tapered to permit easy insertion of snap 162 into the snap opening.

Snap 162 is connected to support bottom 112 at a first extension 192 that extends substantially perpendicular to sides 118 and 120. Sides 118 and 120 also include a second extension 194 that extends the length of sides 118 and 120. Second extension 194 supports sides 118 and 120 and reduces the likelihood of sides 118, 120 buckling during the insertion of snaps 162 into the snap openings and the withdrawal of snaps 162 from the openings.

Figure 4:
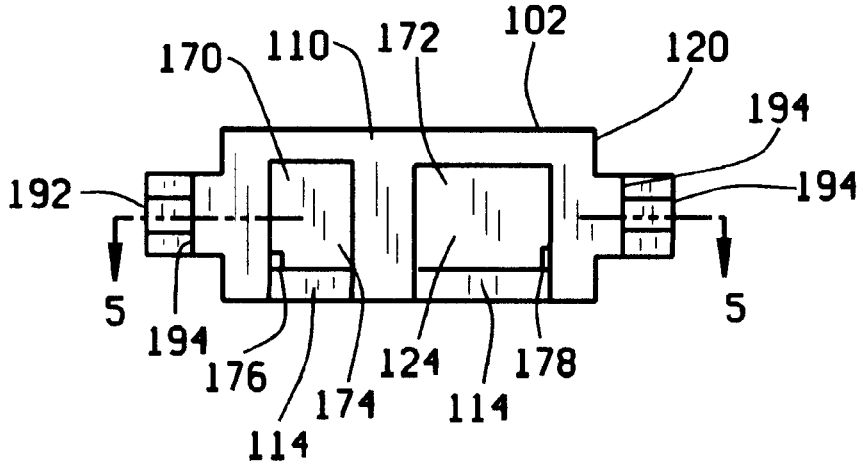
FIG. 4 is a top view of the connector support shown in FIG. 1.

FIG. 4 is a top view of connector support 102 illustrating bottom tabs 176 and 178. Tab 176 extends from front 114 into first bottom opening 174 to provide spacing and support to the first plug connector (not shown in FIG. 4) as described below in more detail. Similarly, tab 178 extends from front 114 into second bottom opening 124 to provide spacing and support to the second plug connector (not shown in FIG. 4).

Figure 5:
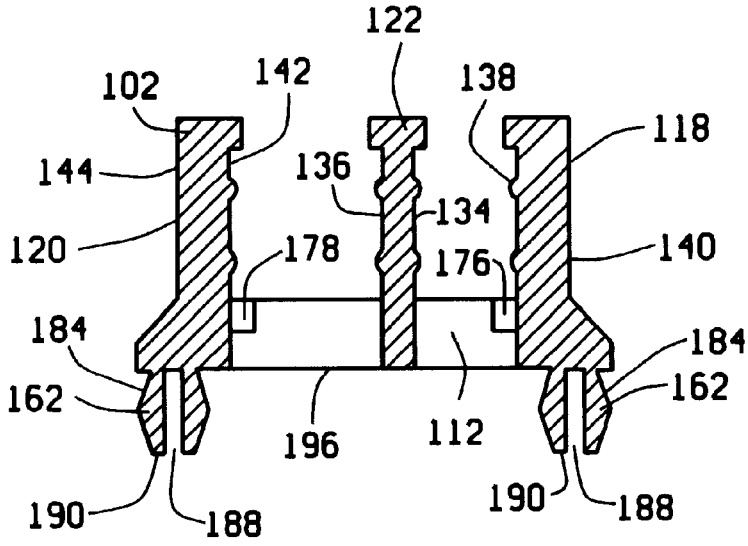
FIG. 5 is a cross section of the connector support shown in FIG. 4 along line AA.

FIG. 5 is a cross section view of support connector 102 further illustrating bottom tabs 176 and 178. Tabs 176 and 178 are a preselected distance from a bottom surface 196 on bottom 112. Tabs 176 and 178 are spaced from bottom surface 196 to properly position the first plug connector (not shown in FIG. 5) and the second plug connector (not shown in FIG. 5).

FIG. 5 also illustrates slot 188 extending from snap end 190 to support bottom 112. Top portion 184 of snap 162 is tapered as explained above. The degree of tapering of top portion 184 can be altered to provide different retention characteristics. A steep taper will severely restrict withdrawal of snap 162 from the snap opening (not shown in FIG. 5). Changing the degree of tapering of top portion 184 to provide different retention characteristics is well understood in the art and therefore, will not be discussed further.

Figure 6:
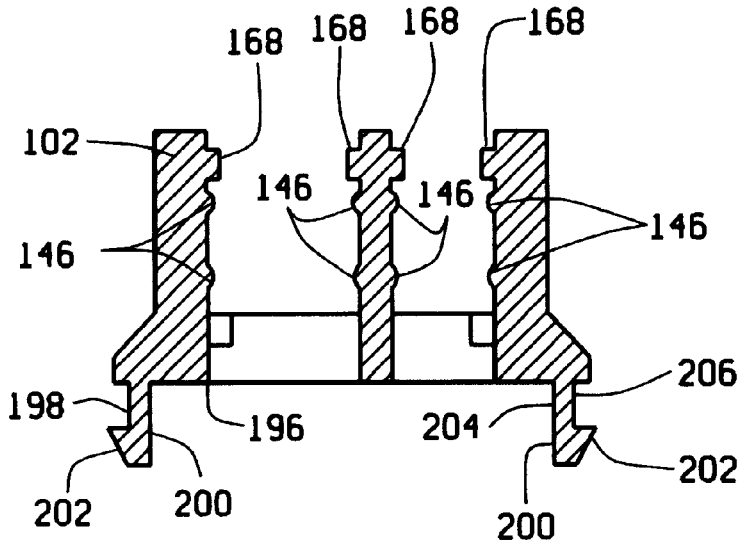
FIG. 6 is a cross section of an alternative connector support.

FIG. 6 is another embodiment of connector support 102 including cantilevered snaps 198. Snaps 198 extend from bottom surface 196 and include a central member 200 and a tab 202. Central member 200, in one embodiment, has a substantially semi-circular cross-section having a flat side 204 and a rounded side 206. Tab 202 extends from rounded side 206 and is substantially wedge-shaped.

Alternative configurations for the snaps are also possible. For example, the snaps can be press fit snaps that have multiple tabs extending therefrom. The press fit tabs have a slot extending therethrough. The multiple tabs are positioned on an outer surface of the snaps and extend outwardly from the snaps. The slot may extend a length of the snaps. Alternatively, the slot extends only partially through the snaps.

Figure 7:
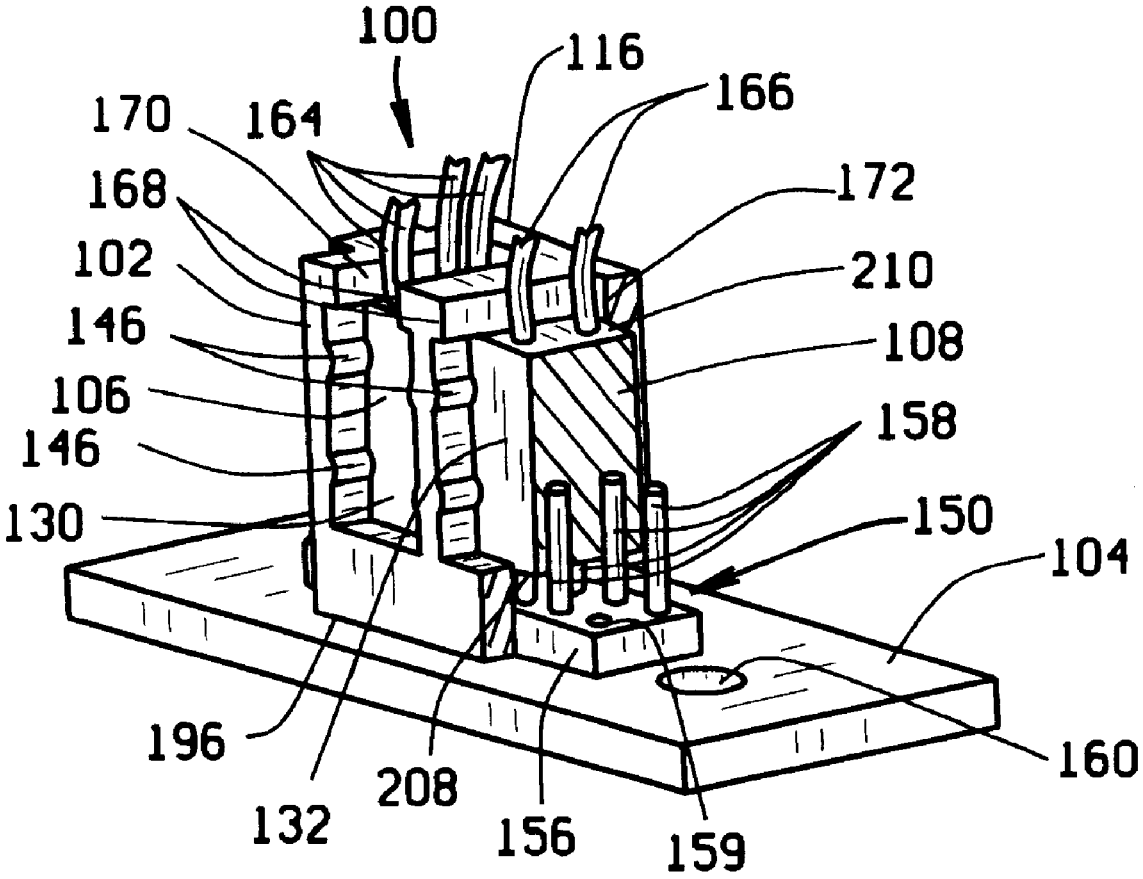
FIG. 7 is a cut-away perspective view of the connector holder assembly shown in FIG. 1.

FIG. 7 is a cut-away perspective view of connector holder assembly 100 with connector support 102 and plug connectors 106 and 108 positioned on PCB 104. Plug connector 106 includes a bottom (not shown) having a first plurality of pin openings (not shown). Similarly, plug connector 108 includes a bottom 208 having a second plurality of pin openings (not shown). The pin openings permit the first header assembly pins (not shown in FIG. 6) and pins 158 to extend into connectors 106 and 108, respectively. As explained above, the first header assembly pins make electrical contact with connector wires 164 and pins 158 make electrical contact with connector wires 166. Connector wires 164 extend from a top (not shown) of plug connector 106 and connector wires 166 extend from a top 210 of plug connector 108. When plug connectors 106 and 108 are fully inserted into cavities 130 and 132, respectively, connector wires 164 and 166 extend through connector top openings 170 and 172, respectively.

In one embodiment, connector support 102 contacts PCB 104 while plug connectors 106 and 108 are positioned a predetermined distance above the first platform (not shown in FIG. 6) and second platform 156, respectively. Plug connectors 106 and 108 are maintained a predetermined distance from the first platform and platform 156 respectively, by first and second bottom tabs (not shown in FIG. 6), respectively. In addition, the first platform and second platform 156 extend into the first and second bottom openings (not shown in FIG. 6), respectively. Thus, the first header assembly (not shown in FIG. 6) fits within the first bottom opening (not shown in FIG. 6) and second header assembly 150 fits within the second bottom openings (not shown in FIG. 6).

As further illustrated in FIG. 6, plug connector 108 is held in position in cavity 132 by tabs 168, back 116, the second bottom tab (not shown in FIG. 6), ribs 146, and pins 158. Similarly, plug connector 106 is held in position in cavity 130 by tabs 168, back 116, the first bottom tab (not shown in FIG. 6), ribs 146, and the first plurality of pins (not shown in FIG. 6). Plug connectors 106 and 108 are restricted in all axes of motion by connector support 102, the first plurality of pins, and pins 158.

A method of connecting plug connectors 106 and 108 to PCB 104 includes the step of inserting plug connectors 106 and 108 into connector support 102 through plug openings 126 and 128, respectively, such that the pin openings are in communication with the first bottom opening and second bottom opening 124. Connector support 102 is the positioned on PCB 102 such that the snap (not shown in FIG. 6) is in alignment with snap opening 160 and the pin openings on plug connectors 106 and 108 are in alignment with the first plurality of pins and pins 158. Then connector support 102 and plug connectors 106 and 108 are placed on PCB 104 such that connector support 102 is in contact with PCB 104, the snaps are in snap openings 160, and the first plurality of pins and pins 158 are positioned within the pin openings. The method further includes the step of positioning plug connectors 106 and 108 adjacent ribs 146 such that ribs 146 contact connectors 106 and 108 and retain them in position in cavities 130 and 132, respectively. The method further includes the step of flexing the snap to engage snap opening 160 and to retain the snap within snap opening 160. In addition, the method includes the step of extending wires 164 and 166 through top openings 170 and 172, respectively.

Of course, any number of plug connectors could be accommodated by a large enough connector support. The support could include 1, 3, 10, or even more cavities. The cavities could be arranged in a single row or in a plurality of rows. In this manner, a connector requiring connection to a PCB having a large number of pins could be assembled from many small connectors. Thus, although an exemplary embodiment includes two plug connectors and two cavities, this description is not limited to a connector support including two cavities for housing two plug connectors. Instead, it applies to a connector support having any number of cavities and any number of plug connectors.

The connector support firmly holds the plug connectors on a plurality of header assembly pins to make an electrical connection between the pins and a plurality of wires. The support provides reduced movement of the connectors in all axes except for the axis substantially parallel to the path of insertion of the plug connectors into the connector support. The support permits multiple small connectors to replace a single larger connector having the same number of pin openings. This permits a passage opening in the meter to be smaller and still allow passage of a holder connector assembly having a large number of pin openings.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. Apparatus comprising:

a connector support including a top, a bottom, a front, a back, a first end, a second end, and an intermediate wall, a first bottom opening extending through said bottom, and a first plug opening extending through said front;

a printed circuit board including a first header assembly comprising a plurality of pins, said header assembly configured to fit within said first bottom opening; and a first plug connector configured to be positioned through said first plug opening and connected to said header assembly.

2. An apparatus in accordance with claim 1 wherein said first plug further comprises a plurality of pin openings, said pins extending into said pin openings when said connector support and said plug connector are attached to said printed circuit board.

3. An apparatus in accordance with claim 1 wherein said first end of said connector support includes an inner side and said second end of said connector support includes an inner side, said inner sides and said intermediate wall include a plurality of ribs.

4. An apparatus in accordance with claim 3 wherein said ribs are tapered from said front to said back.

5. An apparatus in accordance with claim 1 wherein said connector support further comprises a snap and said printed circuit board further comprises a snap opening, said snap including a top portion, a bottom portion, and a slot, said top portion tapered with respect to said bottom portion, said slot allowing for flexure of said snap during engagement with said snap opening.

6. An apparatus in accordance with claim 1 wherein said printed circuit board further comprises a second header assembly including a plurality of pins, and said connector support including a second bottom opening extending through said bottom and a second plug opening extending through said front wall, said second header assembly extending through said second bottom opening when said connector support is attached to said printed circuit board.

7. An apparatus in accordance with claim 6 further comprising a second plug connector configured to be positioned through said second plug connector opening and connected to said second header assembly when said connector support is attached to said printed circuit board.

8. An apparatus in accordance with claim 7 wherein said second plug further comprises a plurality of pin openings, said second header assembly pins extending into said second connector pin openings when said connector support and said connector are attached to said printed circuit board.

9. An apparatus in accordance with claim 7 wherein said first and second connectors include a plurality of wires, said top of said connector support including a first top opening and a second top opening, said wires configured to extend through said top openings when said connectors are positioned through said first and second plug openings.

10. A connector holder assembly comprising:

a connector support including at least one header opening, at least one plug opening, and at least one snap, said plug opening configured to permit insertion of a plug connector into said connector support; and a printed circuit board including at least one snap opening, said snap configured to engage said snap opening and maintain said connector support in contact with said printed circuit board, said printed circuit board further including at least one header assembly comprising a plurality of pins, said header assembly configured to fit within said header opening.

11. A connector holder assembly in accordance with claim 10 wherein said connector support further comprises a top, a bottom, a front, a back, a first end, a second end, and an intermediate wall, a first cavity formed by said back, said first end, and said intermediate wall, and a second cavity formed by said back, said second end, and said intermediate wall, said at least one plug opening comprising a first plug opening and a second plug opening, each said plug opening extending through said front, and said at least one header opening comprising a first header opening and a second header opening, said header openings extending through said bottom of said connector.

12. A connector holder assembly in accordance with claim 11 wherein said intermediate wall includes a first side and a second side, said first end includes an inner side and an outer side, and said second end includes an inner side and an outer side, said inner side of said first end, said inner side of said second end, and said first and second sides of said intermediate wall include at least one rib extending into said cavities.

13. A connector holder assembly in accordance with claim 11 wherein said snaps include a top portion, a bottom portion, and a slot allowing flexure of said snap during engagement with said snap opening, said top portion configured to restrict withdrawal of said snap from said snap opening.

14. A connector holder assembly in accordance with claim 11 wherein said snaps comprise cantilevered snaps that include a central member and a tab extending outwardly from said central member.

15. A connector holder assembly in accordance with claim 11 wherein said at least one header assembly includes a first header assembly including three pins and a second header assembly including five pins.

16. A connector holder assembly in accordance with claim 11 further comprising a first plug connector and a second plug connector configured to fit within said first cavity and said second cavity, respectively.

17. A connector holder assembly in accordance with claim 16 wherein said plug connectors include a plurality of wires, said top of said connector support including a first opening and a second opening, said wires configured to extend through said openings when said connectors are inserted into said cavities.

18. A connector holder assembly in accordance with claim 16 wherein said plug connectors include a plurality of pin openings, said pins configured to be positioned within said pin openings when said plug connectors are inserted into said cavities and said connector support is positioned on said printed circuit board.

19. A connector holder assembly in accordance with claim 11 wherein said connector support back includes a first cutout in communication with said first cavity and a second cutout in communication with said second cavity.

20. A connector holder assembly in accordance with claim 11 wherein said bottom includes a tab for positioning said connector support on said printed circuit board.

21. A connector holder assembly in accordance with claim 10 wherein said connector support comprises a molded thermoplastic connector support.

22. A method of connecting at least one plug connector to a printed circuit board with a connector support, the printed circuit board including at least one snap opening and at least one header assembly including a plurality of pins, the plug connector including a plurality of pin openings and a plurality of wires, the connector support including at least one header opening, at least one plug opening, and at least one snap, said method comprising the steps of:

inserting the plug connector into the connector support;

positioning the connector support on the printed circuit board;

inserting the snap into the snap opening; and positioning the pins within the pin openings.

23. A method in accordance with claim 22 wherein the connector further includes a top, a bottom, a front, a back, a first end, a second end, and an intermediate wall, the at least one plug opening comprising a first plug opening and a second plug opening, each plug opening extending through the front, and the at least one header opening including a first header opening and a second header opening, the header openings extending through the bottom of the connector, wherein said step of inserting the plug connectors into the connector support includes the step of:

inserting the plug connectors through the plug opening such that the pin openings are in communication with the header openings.

24. A method in accordance with claim 23 wherein the ends and the intermediate wall include a plurality of ribs, said step of inserting the plug connector through the first plug opening includes the step of positioning the plug connector adjacent the ribs such that the ribs contact the plug connector.

25. A method in accordance with claim 23 wherein the snap has a slot, said step of inserting the snap into the snap opening includes the step of flexing the snap to engage the snap opening and to retain the snap within the snap opening.

26. A method in accordance with claim 23 wherein the top includes at least one opening extending therethrough, the plug connector includes a plurality of wires extending therefrom, the step of inserting the plug connector includes the step of extending the wires through the top opening.

* * * * *